US008167054B2

(12) United States Patent
Nakashima et al.

(10) Patent No.: US 8,167,054 B2
(45) Date of Patent: May 1, 2012

(54) POWER TOOL

(75) Inventors: Keiji Nakashima, Anjo (JP); Takayuki Tahara, Anjo (JP); Hajime Takeuchi, Anjo (JP); Ryo Sunazuka, Anjo (JP)

(73) Assignee: Makita Corporation, Anjo-shi (JP)

( * ) Notice: Subject to any disclaimer, the term of this patent is extended or adjusted under 35 U.S.C. 154(b) by 0 days.

(21) Appl. No.: 13/022,671

(22) Filed: Feb. 8, 2011

(65) Prior Publication Data

US 2011/0127058 A1 Jun. 2, 2011

Related U.S. Application Data

(63) Continuation of application No. 11/478,656, filed on Jul. 3, 2006.

(30) Foreign Application Priority Data

Jul. 4, 2005 (JP) ..... 2005-195218

(51) Int. Cl.
*E02D 7/06* (2006.01)

(52) U.S. Cl. ..... 173/48; 173/162.1

(58) Field of Classification Search ..... 173/48, 173/162.1, 217; 310/47, 50
See application file for complete search history.

(56) References Cited

U.S. PATENT DOCUMENTS

| | | | |
|---|---|---|---|
| 1,754,222 | A | 4/1930 | Connell |
| 2,024,276 | A | 12/1935 | Desoutter |
| 2,346,778 | A | 4/1944 | Mitchell |
| 2,373,842 | A | 4/1945 | Mitchell |
| 2,383,379 | A | 8/1945 | Forss |
| 2,430,422 | A | 11/1947 | Happe |
| 2,448,500 | A | 8/1948 | Turner |
| 2,500,036 | A | 3/1950 | Horvath |

(Continued)

FOREIGN PATENT DOCUMENTS

DE 40 00 861 A1 7/1991

(Continued)

OTHER PUBLICATIONS

Jan. 3, 2008 European Search Report for European Patent Application No. 06 01 3766.

*Primary Examiner* — Rinaldi Rada
*Assistant Examiner* — Nathaniel Chukwurah
(74) *Attorney, Agent, or Firm* — Oliff & Berridge, PLC

(57) ABSTRACT

It is an object of the invention to provide an effective technique for a motor support structure of a power tool to reduce vibration. A representative reciprocating power tool may include a tool body, a tool bit, a grip, a motor, a tool bit side bearing, a grip side bearing, a tool bit side bearing housing, a grip and an elastic element. The tool bit side bearing housing houses the tool bit side bearing, while the grip side bearing housing houses the grip side bearing. The elastic element is disposed between the grip side bearing housing and the grip wherein the grip side bearing housing is elastically supported by the grip via the elastic element. According to the invention, because the grip is adapted to support the grip side bearing housing via the elastic element and the rigidity of the grip side bearing housing can be increased and vibration of the grip side bearing housing can be reduced. Further, the elastic element can absorb manufacturing errors caused between the tool body and the grip when the grip is mounted to the tool body.

4 Claims, 4 Drawing Sheets

U.S. PATENT DOCUMENTS

| | | | | |
|---|---|---|---|---|
| 2,711,461 | A | 6/1955 | Happe | |
| 3,002,794 | A | 10/1961 | Bluemink | |
| 3,294,183 | A | 12/1966 | Riley, Jr. et al. | |
| 3,336,490 | A | 8/1967 | Yelpo | |
| 3,413,498 | A | 11/1968 | Bowen, III et al. | |
| 3,440,465 | A | 4/1969 | Pratt et al. | |
| 3,491,840 | A | 1/1970 | Haviland | |
| 3,519,858 | A | 7/1970 | Morganson | |
| 3,671,699 | A | 6/1972 | Matthews | |
| 3,709,570 | A | 1/1973 | Galbato | |
| 3,785,443 | A | 1/1974 | Armbruster | |
| 3,808,904 | A | 5/1974 | Gotsch et al. | |
| 3,831,048 | A | 8/1974 | Wagner | |
| 4,032,203 | A | 6/1977 | Alessio | |
| 4,487,270 | A | 12/1984 | Huber | |
| 4,523,116 | A * | 6/1985 | Dibbern et al. | 310/71 |
| 4,879,847 | A | 11/1989 | Butzen et al. | |
| 5,692,574 | A | 12/1997 | Terada | |
| 6,796,389 | B2 | 9/2004 | Pusateri et al. | |
| 6,858,286 | B1 | 2/2005 | Simm et al. | |
| 2002/0096341 | A1 | 7/2002 | Hagan et al. | |
| 2002/0098938 | A1 | 7/2002 | Milbourne et al. | |
| 2003/0121680 | A1 * | 7/2003 | Izumisawa et al. | 173/93.5 |
| 2004/0098836 | A1 | 5/2004 | Walker et al. | |
| 2005/0155778 | A1 | 7/2005 | Ishida et al. | |

FOREIGN PATENT DOCUMENTS

| | | | |
|---|---|---|---|
| DE | 195 25 251 | A1 | 1/1996 |
| JP | U 59-160111 | | 10/1984 |
| JP | U-59-160111 | | 10/1984 |
| JP | A 2003-025255 | | 1/2003 |
| JP | A-2003-025255 | | 1/2003 |
| JP | A-2003025255 | | 1/2003 |
| JP | A-2004-106136 | | 4/2004 |
| JP | A-2004-524481 | | 8/2004 |
| JP | A 2004-524481 | | 8/2004 |
| JP | A 2006-062044 | | 3/2006 |
| WO | WO 02/059491 | A2 | 8/2002 |
| WO | WO 2002/059491 | A2 | 8/2002 |

* cited by examiner

POWER TOOL

This is a Continuation of application Ser. No. 11/478,656 filed Jul. 3, 2006, which claims the benefit of Japanese Patent Application No. 2005-195218 filed Jul. 4, 2005. The disclosures of the prior applications are hereby incorporated by reference herein in their entirety.

BACKGROUND OF THE INVENTION

1. Field of the Invention

The invention relates to a power tool and more particularly, to a motor support structure of a power tool.

2. Description of the Related Art

Japanese non-examined laid-open Patent Publication No. 2004-106136 discloses an electric hammer drill used for drilling a workpiece such as a concrete. In the known electric hammer drill, a motor for driving a drill bit is disposed in the tip end (front end) region of the hammer drill and housed within a motor housing such that axial direction of the motor is parallel to the axial direction of the drill bit. A front portion on the tool bit side and a rear portion on the grip side of a rotating shaft of the motor are rotatably supported by respective bearings. A grip side bearing housing for housing the rear grip side bearing extends toward the grip and is covered by a grip cover disposed on the rear end portion of the motor housing.

According to the known art, the grip side bearing housing for the rear bearing extends toward the grip, the extending end of the grip side bearing housing is free and as a result, vibration may be caused in the free end when the motor is driven. As a measure against such vibration, it is conceivable for example to provide an enforcing rib extending from the rear wall of the motor housing in order to increase the rigidity of the grip side bearing housing. However, on the other hand, the known hammer drill generally has a ring-like member operated by a user of the hammer drill to change the direction of rotation of the motor and such ring-like member is generally disposed in the outer peripheral region of the grip side bearing housing. Therefore, due to the ring-like member on the peripheral region of the grip side bearing housing, the enforcing rib cannot be provided as a measure to increase the rigidity of the grip side bearing housing.

SUMMARY OF THE INVENTION

Accordingly, it is an object of the invention to provide an effective technique for a motor support structure of a power tool to reduce vibration.

The object as described above can be achieved by the claimed invention. According to the representative invention, a representative reciprocating power tool may include a tool body, a tool bit, a grip, a motor, a tool bit side bearing, a grip side bearing, a tool bit side bearing housing, a grip and an elastic element. The tool bit is disposed in a tip end region of the tool body to perform a predetermined operation on a workpiece. The grip is mounted on the tool body on the side opposite to the tool bit. The motor is housed within the tool body to drive the tool bit. The motor may have a rotatable shaft and the tool bit side bearing and the grip side bearing rotatably support the rotating shaft of the motor. The tool bit side bearing housing houses the tool bit side bearing, while the grip side bearing housing houses the grip side bearing. The elastic element is disposed between the grip side bearing housing and the grip wherein the grip side bearing housing is elastically supported by the grip via the elastic element.

The "power tool" according to the invention typically includes not only impact power tools such as an electric hammer and a hammer drill, but also power tools in which a grip side bearing housing extends from a tool body toward a grip. The "grip" according to the invention suitably includes both a grip that extends in a direction crossing the axial direction of the motor and a grip that extends in a direction substantially parallel to the axial direction of the motor. The "elastic element" may include a shock-absorbing material such as a rubber or a flexible synthetic resin.

According to the invention, because the grip is adapted to support the grip side bearing housing via the elastic element and the rigidity of the grip side bearing housing can be increased and vibration of the grip side bearing housing can be reduced. Further, the elastic element can absorb manufacturing errors caused between the tool body and the grip when the grip is mounted to the tool body. Thus, the assembling ease can be enhanced.

The representative power tool may preferably include a ring-like member disposed on an outer surface of the grip side bearing housing. Such ring-like member is manually operated by a user of the power tool to change the driving mode of the tool bit. In such case, the elastic element may be disposed on the grip side bearing housing in a region other than the region where the ring-like member is disposed. For example, when the ring-like member is disposed around an outer circumferential surface of the grip side bearing housing at a predetermined longitudinal region of the grip side bearing housing, the elastic element may preferably be disposed at an longitudinal end region of the grip side bearing housing toward the grip. Further, the elastic element may preferably be integrated with a rubber cover that is disposed on an outer periphery of the grip to contact with the palm and/or fingers of the user of the power tool. Other objects, features and advantages of the invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
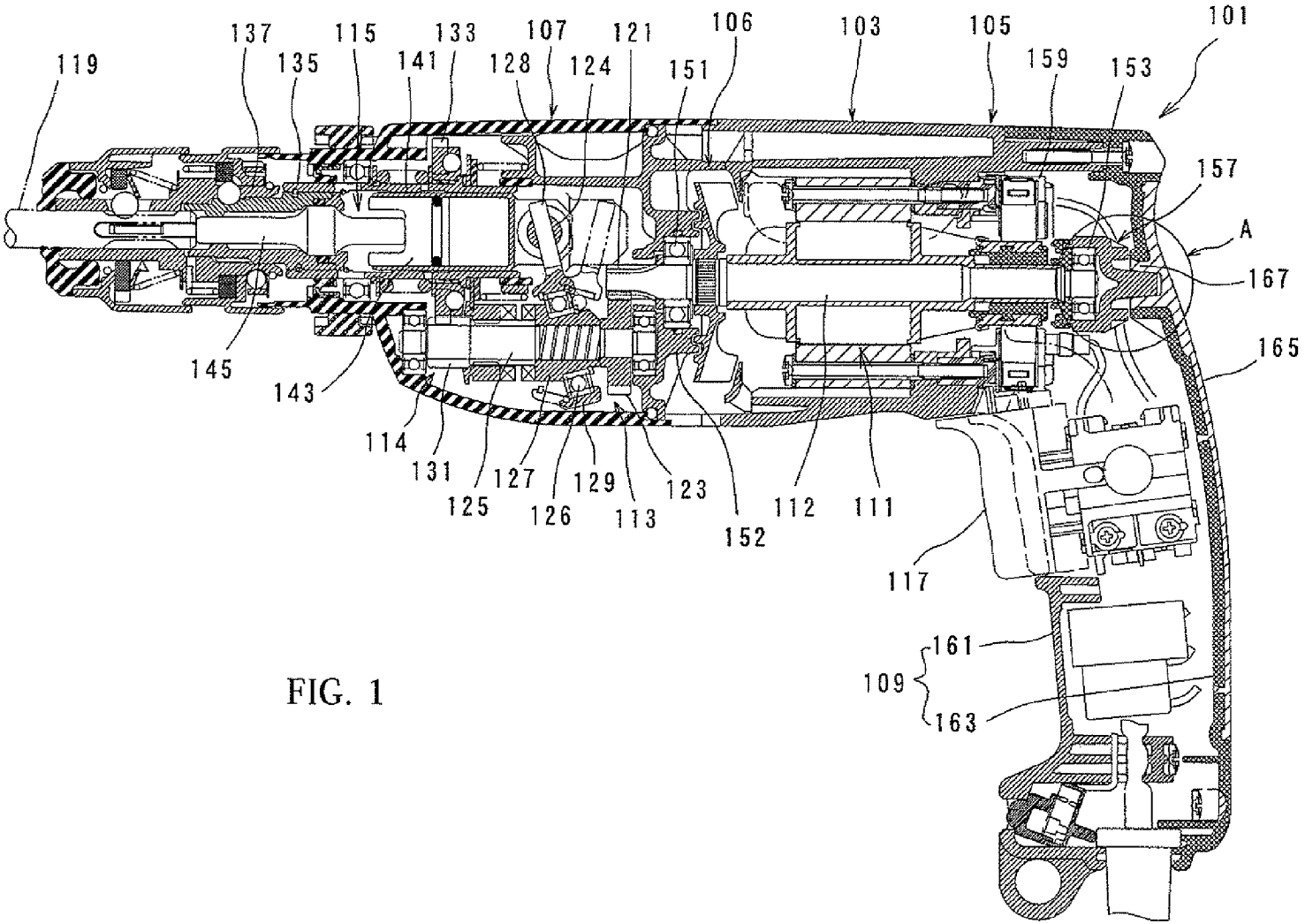
FIG. 1 is a sectional side view showing an entire hammer drill according to an embodiment of the invention.
Figure 2:
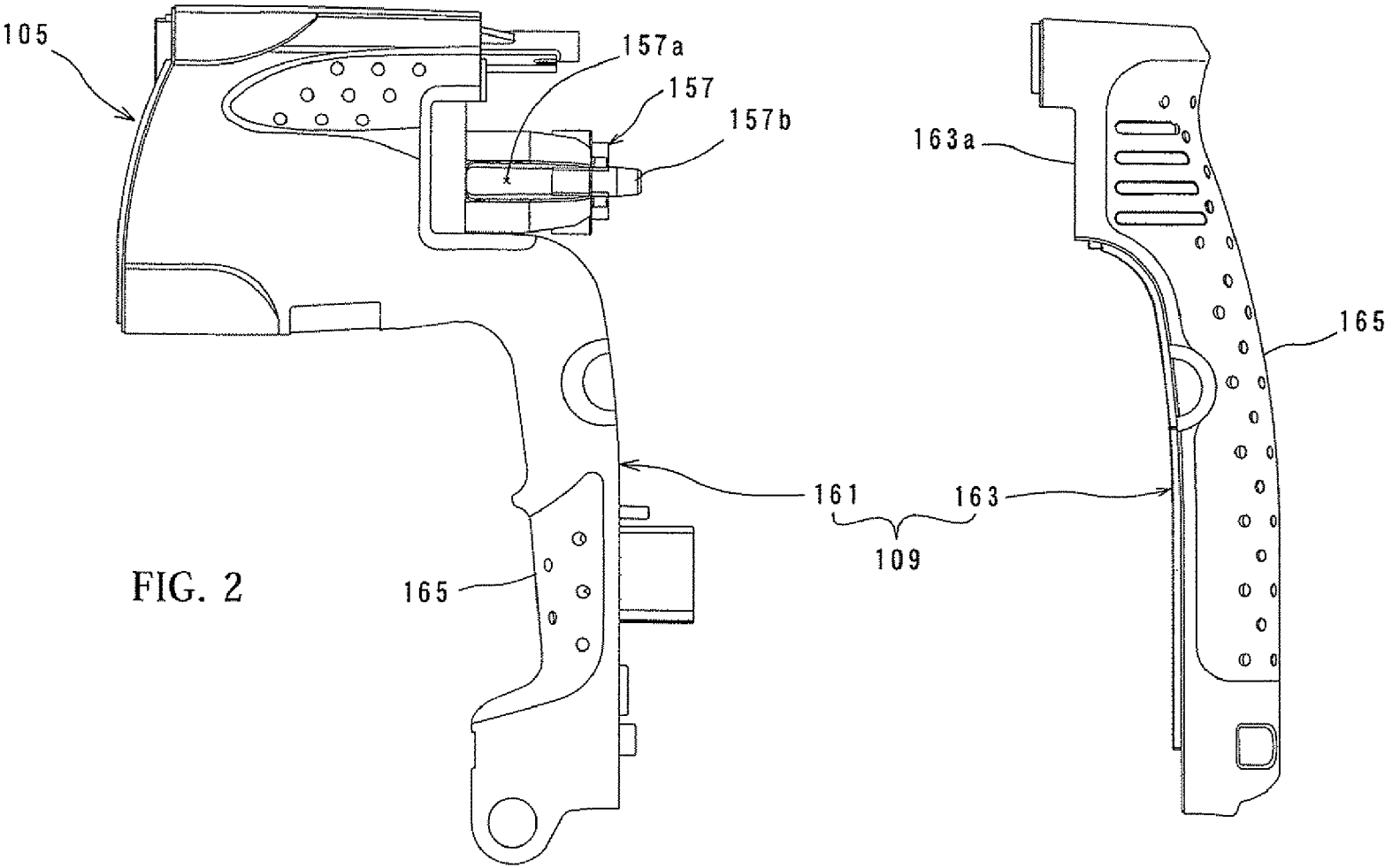
FIG. 2 is a side view showing a motor housing and a grip.
Figure 3:
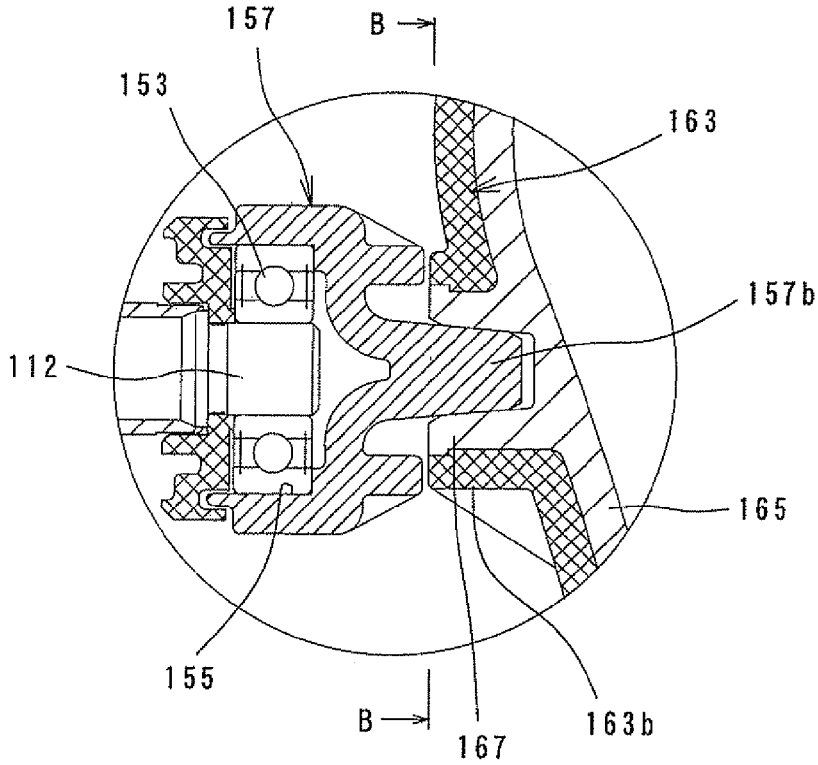
FIG. 3 is an enlarged view of circled part A in FIG. 1.
Figure 4:
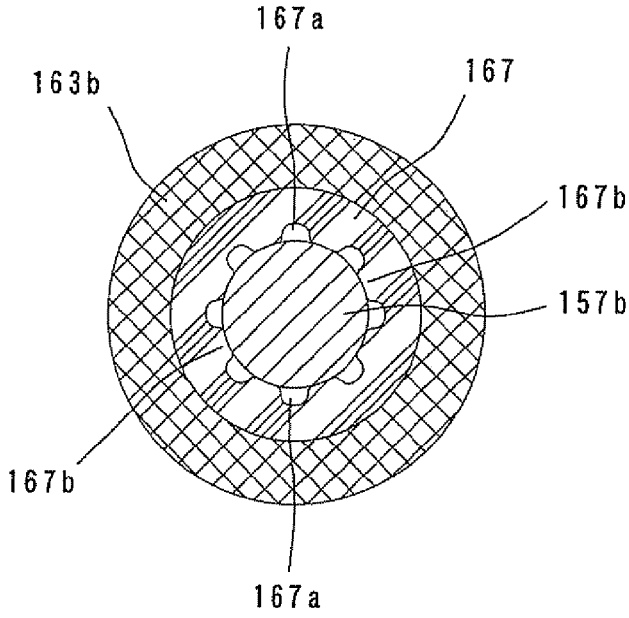
FIG. 4 is a sectional view taken along line B-B in FIG. 3.

A representative embodiment of the invention is described with reference to FIGS. 1 to 4. FIG. 1 is a sectional side view of an entire electric hammer drill 101 as a representative embodiment of a power tool according to the invention. FIG. 2 is a side view showing a motor housing and a grip. FIG. 3 is an enlarged view of circled part "A" in FIG. 1. FIG. 4 is a sectional view taken along line B-B in FIG. 3. As shown in FIG. 1, the electric hammer drill 101 includes a body 103, a drill bit 119 detachably coupled to the tip end region (on the left side as viewed in FIG. 1) of the body 103 via a tool holder 137, and a grip 109 held by a user and connected to a region of the body 103 on the opposite side of the drill bit 119. The body 103 is a feature that corresponds to the "tool body" according to the invention. The drill bit 119 is mounted such that it is allowed to reciprocate with respect to the tool holder 137 in an axial direction and rotate together with the tool holder 137 in a circumferential direction. The drill bit 119 is a feature that corresponds to the "tool bit" according to the invention. In the following description, for the sake of convenience of explanation, the side of the drill bit 119 is taken as the front side and the side of the grip 109 as the rear side.

The body 103 includes a motor housing 105 that houses a driving motor 111, and a gear housing 107 that houses a motion converting mechanism 113, a power transmitting mechanism 114 and a striking mechanism 115. The motor housing 105 and the gear housing 107 are connected to each other by screws or other similar devices (not shown in the drawings). The motion converting mechanism 113, the power transmitting mechanism 114 and the striking mechanism 115 form a driving mechanism of the drill bit 119. An inner housing 106 is disposed within the gear housing 107 on the side adjacent to the joint with the motor housing 105 and separates an inner space of the gear housing 107 and an inner space of the motor housing 105.

The motion converting mechanism 113 appropriately converts the rotating output of the driving motor 111 to linear motion and then to transmit it to the striking mechanism 115. As a result, an impact force is generated in the axial direction of the drill bit 119 via the striking mechanism 115. Further, the power transmitting mechanism 114 appropriately reduces the speed of the rotating output of the driving motor 111 and transmits the rotating output as rotation to the drill bit 119. Thus, the drill bit 119 is caused to rotate in the circumferential direction. Here, the driving motor 111 is driven by depressing a trigger 117 mounted on a handgrip 109.

The motion converting mechanism 113 includes a driving gear 121 mounted on the end (front end) of an armature shaft 112 of the driving motor 111 and is caused to rotate in a vertical plane, a driven gear 123 that engages with the driving gear 121, a rotating element 127 that rotates together with the driven gear 123 via an intermediate shaft 125, a swash plate 129 caused to swing in the axial direction of the drill bit 119 by rotation of the rotating element 127, and a cylinder 141 caused to reciprocate by swinging movement of the swash plate 129. The armature shaft. 112 is a feature that corresponds to the "shaft of the motor" according to this invention. The intermediate shaft 125 is disposed parallel (horizontally) to the axial direction of the drill bit 119. The outer surface of the rotating element 127 that is fitted onto the intermediate shaft 125 is inclined at a predetermined angle with respect to the axis of the intermediate shaft 125. The swash plate 129 is fitted on the inclined outer surface of the rotating element 127 via a ball bearing 126 such that it can rotate with respect to the rotating element 127. The swash plate 129 is caused to swing in the axial direction of the drill bit 119 by rotation of the rotating element 127. Further, the swash plate 129 has a swinging rod 128 extending upward (in the radial direction) from the swash plate 129. The swinging rod 128 is loosely fitted in an engaging member 124 formed in the rear end portion of the cylinder 141. The rotating element 127, the swash plate 129 and the cylinder 141 forms a swinging mechanism.

As shown in FIG. 1, the power transmitting mechanism 114 includes a first transmission gear 131 that is caused to rotate in a vertical plane by the driving motor 111 via the driving gear 121 and the intermediate shaft 125, a second transmission gear 133 that engages with the first transmission gear 131, a sleeve 135 that is caused to rotate together with the second transmission gear 133, and a tool holder 137 that is caused to rotate together with the sleeve 135 in a vertical plane.

As shown in FIG. 1, the striking mechanism 115 includes a striker 143 slidably disposed within the bore of the cylinder 141, and an impact bolt 145 that is slidably disposed within the tool holder 137 and is adapted to transmit the kinetic energy of the striker 143 to the drill bit 119.

In the hammer drill 101 thus constructed, when the user depresses the trigger 117 and the driving motor 111 is driven, the driving gear 121 is caused to rotate in a vertical plane by the rotating output of the driving motor 111. Then, the rotating element 127 is caused to rotate in a vertical plane via the driven gear 123 that engages with the driving gear 121, and the intermediate shaft 125. The swash plate 129 and the swinging rod 128 are then caused to swing in the axial direction of the drill bit 119, which in turn causes the cylinder 141 to slide linearly. The sliding movement of the cylinder 141 causes the action of an air spring within the cylinder 141, which causes the striker 143 to linearly move within the cylinder 141. The striker 143 collides with the impact bolt 145 and transmits the kinetic energy to the drill bit 119.

When the first transmission gear 131 rotates together with the intermediate shaft 125, the sleeve 135 is caused to rotate in a vertical plane via the second transmission gear 133 that engages with the first transmission gear 131. Further, the tool holder 137 and the drill bit 119 supported by the tool holder 137 rotate together with the sleeve 135. Thus, the drill bit 119 performs a drilling operation on a workpiece by a hammering movement in the axial direction and a drilling movement in the circumferential direction.

The hammer drill 101 according to this embodiment can be switched between a hammer drill mode in which the drill bit 119 is caused to perform a hammering movement and a drilling movement as described above and a drill mode in which the drill bit 119 is caused to perform only a drilling movement. A mechanism for such mode changing is not directly related to this invention and therefore will not be described.

The motor housing 105 has a cylindrical shape having an open front end. The driving motor 111 is disposed within a motor housing such that its axial direction is parallel to the axial direction of the drill bit. A front portion and a rear portion of an armature shaft 112 of the driving motor 111 are rotatably supported by respective bearings (ball bearings) 151, 153. The front bearing 151 is housed within a front bearing housing chamber 152 defined by one part of the inner housing 106. The front bearing housing chamber 152 is a feature that corresponds to the "tool bit side bearing housing" according to the invention. The rear bearing 153 is housed within a rear bearing housing chamber 155 that is integrally formed with the motor housing 105. A cylindrical rear bearing housing 157 extends rearward in a bulged form substantially from the central portion in the radial direction of the rear end portion of the motor housing 105. The cylindrical rear bearing housing 157 defines the rear bearing housing chamber 155. A plurality of openings 157*a* (see FIG. 2) for ventilation are formed in the cylindrical rear bearing housing 157 at predetermined intervals in the circumferential direction and extend a predetermined length from the proximal end of the rear bearing housing 157. The rear bearing housing chamber 155 is defined in the extending end portion of the rear bearing housing 157 and surrounded by a wall in its entire region in the circumferential and axial end. The cylindrical rear bearing housing 157 is a feature that corresponds to the "grip side bearing housing" according to the invention. FIG. 1 shows the cylindrical rear bearing housing 157 in a sectional view taken through the opening 157*a*.

Further, as shown in HG. 1, a ring-like operating member 159 for switching the direction of rotation of the driving motor 111 is loosely fitted onto the proximal portion of the cylindrical rear bearing housing 157. The operating member 159 can be manually operated by the user from outside of the motor housing 105. The operating member 159 is a feature that corresponds to the "ring-like member" according to this invention.

As shown in FIGS. 1 and 2, the grip 109 includes a grip body 161 integrally formed with the motor housing 105, and a grip cover 163 mounted to the grip body 161. The grip body 161 extends downward in a direction crossing the axial direction of the driving motor 111 from the rear end underside region of the motor housing 105. The grip body 161 has a groove-like shape in section having an open rear end. The grip cover 163 has a groove-like shape in section having an open front end. The open ends of the grip body 161 and the grip cover 163 are butt-joined by appropriate fastening means such as screws, so that a hollow grip 109 is formed. Further, the grip cover 163 has an extending portion 163*a* that extends upward above the upper end of the grip body 161. An open end of the extending portion 163*a* is butt-joined to the rear end of the motor housing 111, so that the cylindrical rear bearing housing 157 is housed within the extending portion 163*a*. The extending portion 163*a* is a feature that corresponds to the "covering region" according to this invention. The grip cover 163 is formed of synthetic resin.

A rubber cover 165 covers the regions of the outer surface of the grip body 161 and the grip cover 163 which contact the user's palm and/or fingers when the user holds the grip. As shown in FIGS. 1 and 3, an elastic cylindrical portion 167 is integrally formed with the rubber cover 165 on the grip cover 163 side and located to face with the extending end of the cylindrical rear bearing housing 157 of the motor housing 105. The elastic cylindrical portion 167 extends from the outer surface side to the inner surface side of the grip cover 163 and has an open front end. The elastic cylindrical portion 167 supports the extending end portion of the cylindrical rear bearing housing 157 that extends from the motor housing 105. The elastic cylindrical portion 167 has a tapered bore that is concentric with the armature shaft 112 of the driving motor 111. A conical projection 157*b* is formed on the axially extending end surface of the cylindrical rear bearing housing 157. The projection 157*b* is closely fitted into the bore of the elastic cylindrical portion 167, so that the outer region of the projection 157*b* is supported. The rubber cover 165 of the grip cover 163 and the elastic cylindrical portion 167 are features that respectively correspond to the "elastic element" in this invention.

Further, as shown in FIG. 4, the grip cover 163 has a cylindrical portion 163*b* closely fitted onto the elastic cylindrical portion 167. The cylindrical portion 163*b* serves to restrain the elastic cylindrical portion 167 from moving in the radial direction, or in a direction crossing the extending direction of the cylindrical rear bearing housing 157. The cylindrical portion 163*b* is a feature that corresponds to the "rigid region" according to this invention. Further, spline-like grooves 167*a* are formed in the inner surface of the bore of the elastic cylindrical portion 167. Crests 167*b* is defined between the grooves 167*a* contact to support the outer peripheral surface of the projection 157*b* partially in the circumferential direction. Preferably, three or more than three crests 167*b* may be provided to stably support the outer peripheral portion 167. Each crest 167*b* corresponds to the feature of "contacting portion" in the invention.

As described above, in the hammer drill 101 according to this embodiment, the cylindrical rear bearing housing 157 is provided on the rear end region of the motor housing 105 and extends rearward from the central portion in the radial direction of the rear end region. The bearing 153 housed within the cylindrical rear bearing housing 157 supports the rear portion of the armature shaft 112. In such a motor support structure, the axially extending end region of the cylindrical rear bearing housing 157 is supported via the elastic cylindrical portion 167 of the grip 109. Further, the ring-like operating member 159 is fitted on the cylindrical rear bearing housing 157. With such construction, the rigidity of the cylindrical rear bearing housing 157 can be increased, and vibration of the cylindrical rear bearing housing 157 can be reduced which is caused by run-outs developed when the driving motor 111 is rotated. Further, with the construction in which the grip cover 163 supports the cylindrical rear bearing housing 157 via the elastic cylindrical portion 167, the elastic cylindrical portion 167 can absorb manufacturing errors which are caused between the motor housing 105 and the grip cover 163 when the grip cover 163 is mounted to the motor housing 105. Thus, the assembling ease can be enhanced.

Further, in this embodiment, the elastic cylindrical portion 167 is integrally formed with the rubber cover 165 that covers the outer surface of the grip cover 163. Further, as shown in FIG. 4, the cylindrical portion 163*b* of the grip cover 163 supports the periphery of the elastic cylindrical portion 167 and thereby restrains the elastic cylindrical portion 167 from moving radially outward. Therefore, elastic deformation of the elastic cylindrical portion 167 can be prevented, so that the effect of reducing vibration of the cylindrical rear bearing housing 157 can be enhanced. Further, the elastic cylindrical portion 167 is configured to support the outer peripheral surface of the projection 157*b* via the crests 167*b* of the spline-like grooves 167*a*. Therefore, the crests 167*b* can be easily deformed. As a result, the projection 157*b* can be easily fitted into the bore of the elastic cylindrical portion 167 when the grip cover 163 is mounted to the grip body 161.

(Modification of the Representative Embodiment)

Figure 5:
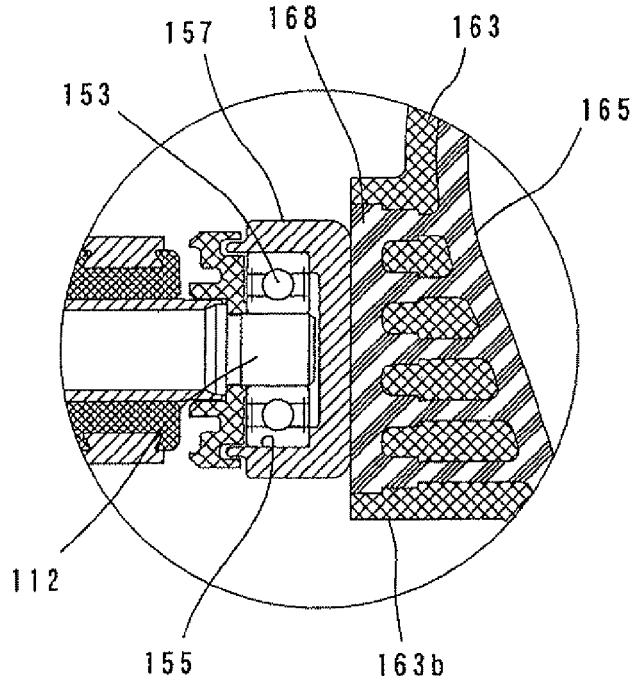
FIG. 5 is a sectional view showing a modification of a support structure of a cylindrical rear bearing housing of a driving motor.
Figure 6:
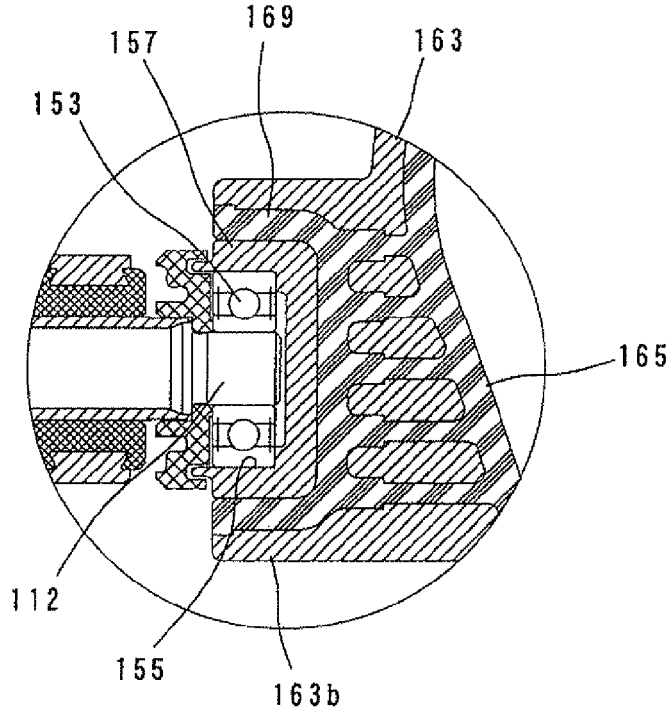
FIG. 6 is a sectional view showing another modification of the support structure of the cylindrical rear bearing housing of the driving motor.

FIGS. 5 and 6 show modifications of the support structure of the grip 109 that support the extending end region of the cylindrical rear bearing housing 157. In the modification as shown in FIG. 5, an elastic portion 168 is provided and configured to be butted in facial contact with the axially extending end surface of the cylindrical rear bearing housing 157 in order to support the cylindrical rear bearing housing 157. The elastic portion 168 is a feature that corresponds to the "elastic element" according to this invention. The elastic portion 168 is adapted to be butted in an appropriately elastically deformed state against the axially extending end surface of the cylindrical rear bearing housing 157 when the grip cover 163 is attached to the grip body 161 and the housing cover 105. Further, the cylindrical portion 163*b* integrally formed with the grip cover 163 supports the outer peripheral surface of the elastic portion 168 and thereby restrains the radial movement of the elastic cylindrical portion 167. With such construction of the support structure, like in the above-mentioned embodiment, the cylindrical rear bearing housing 157 can increase in rigidity, and vibration of the cylindrical rear bearing housing 157 can be reduced which is caused when the driving motor 111 is rotated.

In addition to the support structure by butted facial contact as shown in FIG. 5, the modification as shown in FIG. 6 provides a support structure in which the outer peripheral region of the extending end portion of the cylindrical rear bearing housing 157 is also supported.

Specifically, an elastic cylindrical portion 169 is provided and configured to support both the outer peripheral region and the axial end surface region of the extending end portion of the cylindrical rear bearing housing 157. The elastic cylindrical portion 169 is a feature that corresponds to the "elastic element" according to this invention. Further, the cylindrical portion 163*b* integrally formed with the grip cover 163 supports the outer peripheral surface of the elastic cylindrical portion 169 and thereby restrains the radial movement of the elastic cylindrical portion 169. With such construction of the support structure, the cylindrical rear bearing housing 157 can further increase in rigidity, and the effect of reducing vibration of the cylindrical rear bearing housing 157 can be further enhanced.

Although, in the above-mentioned embodiment, the elastic cylindrical portions 167, 169 and the elastic portion 168 is described as being integrally formed with the rubber cover 165, they may be separately formed. Further, in this embodiment, the grip 109 is described as being connected to the motor housing 105 in such a manner as to extend in a direction crossing the axial direction of the driving motor 111. However, this invention may also be applied to a power tool such as an electric grinder having a grip extending parallel to the axial direction of a driving motor. Further, the hammer drill 101 is described as a representative example of the power tool, but this invention is not limited thereto. This invention can be applied to any power tool in which the grip 109 is connected to the rear end region of the handle 105 and the cylindrical rear bearing housing 157 for housing the rear bearing 153 of the driving motor 111 extends toward the grip 109.

DESCRIPTION OF NUMERALS

101 hammer drill (power tool)
103 body (tool body)
105 motor housing
106 inner housing
107 gear housing
109 grip
111 driving motor (motor)
112 armature shaft (rotating shaft)
113 motion converting mechanism
114 power transmitting mechanism
115 striking mechanism
117 trigger
119 drill bit (tool bit)
121 driving gear
123 driven gear
124 engaging member
125 intermediate shaft
126 ball bearing
127 rotating element
128 swinging rod
129 swash plate
131 first transmission gear
133 second transmission gear
135 sleeve
137 tool holder
141 cylinder
143 striker
145 impact bolt
151 front bearing
152 front bearing housing chamber (tool bit side bearing housing)
153 rear bearing
155 rear bearing housing chamber
157 cylindrical rear bearing housing (grip side bearing housing)
157*a* opening
157*b* projection
159 ring-like operating member (ring-like member)
161 grip body
163 grip cover
163*a* extending portion (covering region)
163*b* cylindrical portion (rigid region)
165 rubber cover
167 elastic cylindrical portion (elastic element)
167*a* groove
167*b* crest
168 elastic portion (elastic element)
169 elastic cylindrical portion (elastic element)

The invention claimed is:

1. A power tool comprising:
a tool body,
a tool bit disposed in a tip end region of the tool body to perform a predetermined operation on a workpiece,
a grip mounted on the tool body on the side opposite to the tool bit,
a motor housed within the tool body to drive the tool bit,
a tool bit side bearing and a grip side bearing that rotatably support a rotating shaft of the motor,
a tool bit side bearing housing that houses the tool bit side bearing,
a grip side bearing housing that houses the grip side bearing and an elastic element disposed between the grip side bearing housing and the grip, wherein
the grip side bearing housing is elastically supported by the grip via the elastic element, and
the elastic element is provided at an outside of the grip side bearing housing to support the grip side bearing housing at least at three regions in the circumferential direction.

2. The power tool as defined in claim 1, wherein the grip includes an elastic member that covers the outer surface of the grip and the elastic element is disposed within the grip integrally with the elastic member.

3. The power tool as defined in claim 2, wherein the grip includes a rigid region that restrains the elastic element from moving in a direction crossing the longitudinal direction of the shaft of the motor.

4. The power tool as defined in claim 1, wherein the grip includes a rigid region that restrains the elastic element from moving in a direction crossing the longitudinal direction of the shaft of the motor.

* * * * *